US005525872A

United States Patent [19]

Achten et al.

[11] Patent Number: 5,525,872

[45] Date of Patent: Jun. 11, 1996

[54] DISCHARGE LAMP OPERATING CIRCUIT WITH WIDE RANGE DIMMING CONTROL

[75] Inventors: Joseph H. M. Achten, Nuenen; Paul R. Veldman, Oss, both of Netherlands

[73] Assignee: U.S. Philips Corporation, New York, N.Y.

[21] Appl. No.: 294,156

[22] Filed: Aug. 22, 1994

[30] Foreign Application Priority Data

Aug. 23, 1993 [BE] Belgium ..... 9300859

[51] Int. Cl.[6] ..... G05F 1/00

[52] U.S. Cl. ..... 315/291; 315/244; 315/307; 315/DIG. 4; 315/DIG. 7

[58] Field of Search ..... 315/224, 291, 315/307, 209 R, 200 R, 208, 205, 194, DIG. 4, DIG. 5, DIG. 7

[56] References Cited

U.S. PATENT DOCUMENTS

| | | | |
|---|---|---|---|
| 4,928,038 | 5/1990 | Nerone | 315/209 R |
| 5,068,573 | 11/1991 | Bruning et al. | 315/209 R |
| 5,075,599 | 12/1991 | Overgoor et al. | 315/224 |
| 5,075,602 | 12/1991 | Overgoor et al. | 315/307 |
| 5,182,503 | 1/1993 | Denneman et al. | 315/224 |
| 5,198,726 | 3/1993 | Van Meurs et al. | 315/224 |

FOREIGN PATENT DOCUMENTS 0323676 7/1989 European Pat. Off. .

*Primary Examiner*—Robert J. Pascal
*Assistant Examiner*—Haissa Philogene
*Attorney, Agent, or Firm*—Bernard Franzblau

[57] ABSTRACT

A DC/AC convert circuit for operating a discharge lamp includes a branch A having ends suitable for connection to a DC voltage source and comprising a series circuit of two switching elements for generating a periodic voltage by being conducting and non-conducting alternately at a frequency f, each switching element being shunted by a diode. A control circuit is coupled to control electrodes of the switching elements for rendering the switching elements conducting and non-conducting alternately at the frequency f. A load branch B shunts one of the switching elements and comprises an inductor. The discharge lamp is coupled to the load branch B. The power consumed by the discharge lamp is adjusted by adjusting the value of the difference Tt-Td, in which Tt is a time interval during which one of the switching elements is conducting during a half cycle of the periodic voltage, and Td is the time interval during which a diode is conducting during the same half cycle of the periodic voltage. Stable operation of the discharge lamp is achieved over a wide range of the adjustable power.

13 Claims, 4 Drawing Sheets

DISCHARGE LAMP OPERATING CIRCUIT WITH WIDE RANGE DIMMING CONTROL

BACKGROUND OF THE INVENTION

This invention relates to a circuit arrangement for operating a discharge lamp, comprising a DC-AC converter provided with a branch A having ends suitable for connection to a DC voltage source and comprising a series circuit of two switching elements for generating a periodic voltage by being conducting and non-conducting alternately at a frequency f, each switching element being shunted by a diode, a control circuit coupled to control electrodes of the switching elements for rendering the switching elements conducting and non-conducting alternately at the frequency f, a load branch B which shunts one of the switching elements and which comprises inductive means L and means for coupling the discharge lamp to the load branch B, and means M for adjusting the power consumed by the discharge lamp.

Such a circuit is known from European Patent 323676, which corresponds to U.S. Pat. No. 4,949,016. In this Patent, both the frequency f of the DC-AC converter and the time interval Tt during which each of the switching elements is conducting are presented as parameters by which it is possible to adjust the power consumed by the lamp. It was found that the use of one of these parameters makes it possible to adjust the luminous flux of the lamp over a wide range by comparatively simple electronic auxiliary means. A disadvantage which may arise when the frequency f is used as the parameter is that the relation between the power consumed by the discharge lamp and the frequency f is not unequivocal over the entire range of frequencies which can be set. Especially when the power consumed by the discharge lamp is comparatively low, each value of the frequency f in a certain range of this frequency f can correspond to two lamp power values. This results in an unstable burning of the lamp. It was found that for very many discharge lamps in practice, especially compact fluorescent lamps, it is not possible for this reason to adjust comparatively low values of the power consumed by the discharge lamp. In other words, the range over which the discharge lamp can be dimmed is limited.

It should be noted that European Patent 482705, which corresponds to U.S. Pat. No. 5,198,726, describes a possible solution to this problem. This solution, however, is comparatively complicated and expensive.

An important disadvantage connected with the use of the time interval Tt as a parameter is that, depending on the dimensions of the discharge lamp, the power consumed by the discharge lamp is a very steep function of the time interval Tt in a certain range. This means in practice that additional control measures are necessary for adjusting the power consumed by the discharge lamp by means of the time interval Tt in this range. These additional control means also render the use of this parameter comparatively complicated and expensive.

SUMMARY OF THE INVENTION

The invention has for its object, inter alia, to provide a circuit arrangement with which the power consumed by a discharge lamp operated by means of the circuit arrangement can be adjusted over a comparatively wide range by comparatively simple means.

According to the invention, this object is achieved in that the means M comprise means Mp for adjusting the value of the difference Tt-Td, in which Tt is a time interval during which one of the switching elements is conducting during a half cycle of the periodic voltage, and Td is a time interval during which a diode is conducting during this same half cycle of the periodic voltage.

It was found for discharge lamps of various types that there is an unequivocal relation between the parameter Tt-Td and the power consumed by the discharge lamp. In addition, the power consumed by the discharge lamp is a function of the parameter Tt-Td which is not excessively steep. As a result it is possible to adjust the luminous flux of the discharge lamp over a comparatively wide range with the use of the parameter Tt-Td.

An advantageous embodiment of a circuit arrangement according to the invention is characterized in that the means Mp comprise means for generating a signal S1 which is a measure of Tt-Td, means for generating a signal S2 which is a measure for a desired value of Tt-Td, and means for rendering the signal S1 substantially equal to the signal S2.

In this advantageous embodiment of a circuit arrangement according to the invention, the means Mp are realised in a comparatively simple manner.

A further advantageous embodiment of a circuit arrangement according to the invention is characterized in that the means for generating the signal S2 comprise means for generating a signal P1 which is a measure of the power consumed by the discharge lamp, and means for generating a signal P2 which is a measure of a desired value of the power consumed by the discharge lamp.

It is possible with this further advantageous embodiment of a circuit arrangement according to the invention to control the power consumed by the discharge lamp at a substantially constant level, independently of ambient parameters such as, for example, the ambient temperature.

BRIEF DESCRIPTION OF THE DRAWINGS

Embodiments of a circuit arrangement according to the invention will be explained in more detail with reference to the accompanying drawing, in which.

DESCRIPTION OF THE PREFERRED EMBODIMENT

Figure 1:
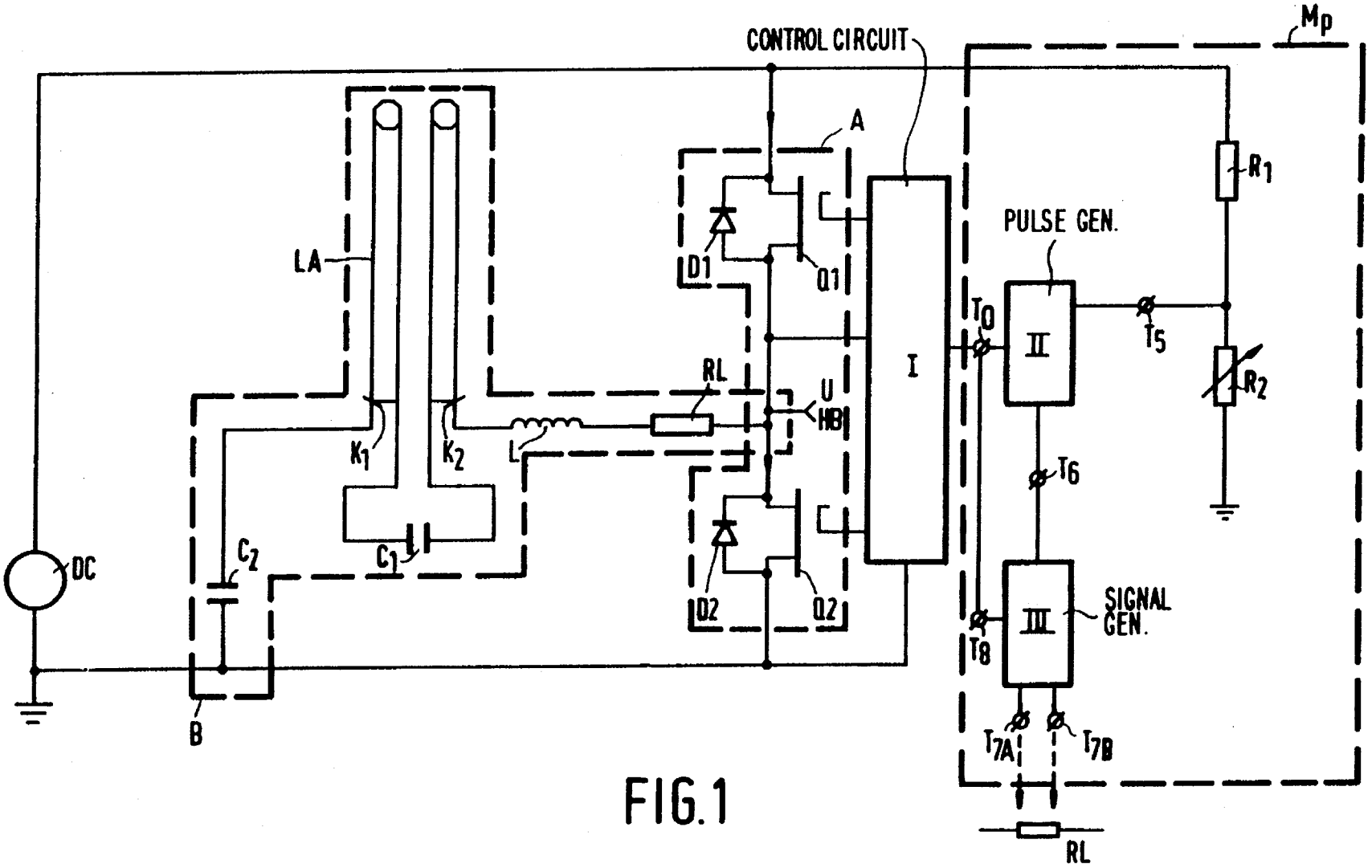
FIG. 1 is a diagram of a circuit arrangement according to the invention.

In FIG. 1, A denotes a branch provided with ends suitable for connection to a DC voltage source and comprising a series circuit of two switching elements Q1, Q2 for generating a periodic voltage by being conducting and nonconducting alternately with a frequency f, each switching element being shunted by a respective diode D1, D2. The ends of branch A are connected to a voltage source DC. B is a load branch which shunts the switching element Q2 and which comprises inductive means L and means K1 and K2 for coupling the discharge lamp to the load branch B. A discharge lamp La, shown as a compact fluorescent lamp, is coupled to the load branch B through the means K1 and K2. The discharge lamp La is shunted by a capacitor C1. The load branch B also comprises a capacitor C2 connected in series with the lamp. Control electrodes of switching elements Q1 and Q2 are coupled to control circuit I for rendering the switching elements alternately conducting at the frequency f. An input of control circuit I is coupled to an output TO of means Mp for adjusting the value of the difference Tt-Td, in which Tt is a time interval during which one of the switching elements is conducting during a half cycle of the periodic voltage and Td is a time interval during which a diode is conducting during the same half cycle of the periodic voltage. The means Mp are built up from circuit portions II and III, an ohmic resistor R1 and a variable resistor R2. Ohmic resistor R1 and variable resistor R2 together form means for generating a signal S2 which is a measure of a desired value of Tt-Td. Circuit portion III forms a means for generating a signal S1 which is a measure of Tt-Td. Circuit portion II forms a means for rendering the signals S1 and S2 substantially equal to one another. A series circuit of ohmic resistor R1 and variable resistor R2 shunts branch A. A common junction point of ohmic resistor R1 and variable resistor R2 is connected to an input T5 of circuit portion II. Respective inputs T7*a* and T7*b* of circuit portion III are interconnected by ohmic resistor RL which is connected in series with the inductive means L of the load branch B. An output of circuit portion III is connected to a further input T6 of circuit portion II. The said output T0 of the means Mp is also an output of circuit portion II. Output T0 of circuit portion II is connected to an input T8 of circuit portion III.

The operation of the circuit arrangement shown in FIG. 1 is as follows. The control circuit I renders the switching elements Q1 and Q2 conducting and nonconducting alternately at a frequency f during lamp operation. As a result, a substantially square-wave voltage at the frequency f is present at the junction point HB of the two switching elements. This substantially square-wave voltage causes a current Ib to flow in the load branch B, the polarity of which changes with the frequency f. To prevent a comparatively high power dissipation in the switching elements, the dimensions of the switching arrangement are chosen so that the load branch forms an inductive impedance at the frequency f. The result is that there will be a phase shift between the substantially square-wave voltage and the current Ib. This means that during each half cycle of the substantially square-wave voltage the current Ib first flows through one of the diodes of branch A during a time interval Td and then through the switching element shunted by the diode during a time interval Tt. It is true for this case that the sum of the time intervals Tt and Td is equal to a half cycle of the substantially square-wave voltage (½f). The current $I_b$ changes polarity at the end of the time interval Td.

A direct current flows through the series arrangement of ohmic resistor R1 and variable resistor R2 during lamp operation. As a result of this, a substantially constant DC voltage is present at input T5 of circuit portion II, the value of which depends on the setting of variable resistor R2. This substantially constant DC voltage forms the signal S2 which is a measure of the desired value of Tt-Td. A signal S1 which is a measure for Tt-Td and which is generated by circuit portion III is applied to input T6 of circuit portion II. The moment that the signal S1 is equal to the signal S2, the circuit portion II generates a voltage pulse at the output T0. As a result of this voltage pulse, the control circuit I renders the switching element which is conducting at that moment non-conducting. The fact that a switching element of branch A becomes non-conducting coincides substantially in time with a rising or falling edge of the substantially squarewave voltage, so also with the end of a half cycle and the beginning of the next half cycle of the substantially squarewave voltage. It is assured in this way that Tt-Td is equal to the desired value of Tt-Td during each half cycle of the substantially squarewave voltage. It is possible to adjust the luminous flux of the discharge lamp La over a comparatively wide range by adjusting this desired value by means of the variable resistor R2.

Figure 2:
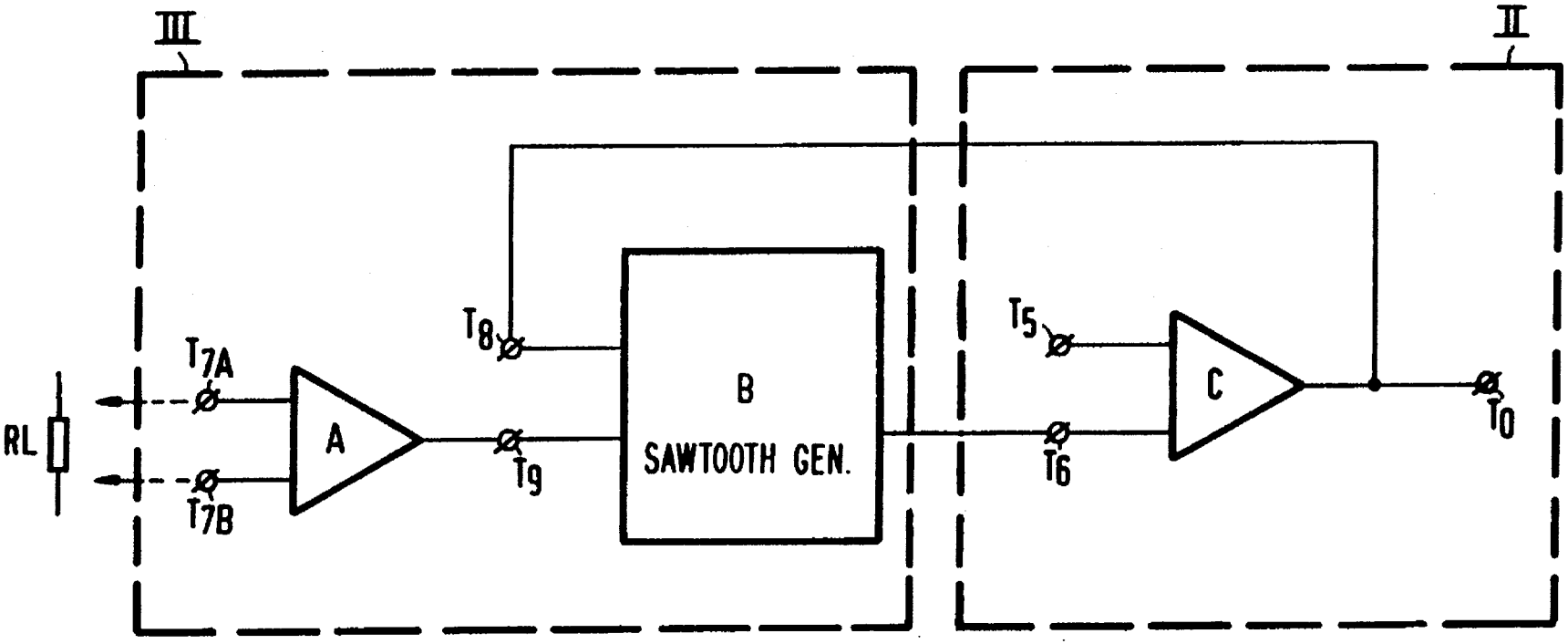
FIG. 2 shows a portion of the circuit arrangement of FIG. 1 in greater detail.

FIG. 2 shows more details of the circuit portions II and III. Circuit portion III is built up from an amplifier A and a sawtooth generator B. Inputs T7*a* and TTo of amplifier A are coupled to the ends of ohmic resistor RL. An output of amplifier A is coupled to an input T9 of sawtooth generator B. A further input of sawtooth generator B is T8. Circuit portion II is formed by amplifier C. An output of sawtooth generator B is connected to an input T6 of amplifier C. T5 is a further input of amplifier C to which the signal S2 is applied during lamp operation. An output TO of amplifier C is connected to input T8 of sawtooth generator B. As is shown in FIG. 1, output TO is also connected to an input of control circuit I.

The operation of the circuit components shown in FIG. 2 is as follows. A voltage pulse is present at output TO at the beginning of every half cycle of the substantially squarewave voltage. This voltage pulse is used, through input T8 of sawtooth generator B, for rendering the amplitude of the sawtooth-shaped voltage generated by sawtooth generator B substantially equal to zero. Then the amplitude of the sawtooth-shaped voltage decreases linearly as a function of time during the time interval Td. At the end of the time interval Td, the current Ib changes polarity. This polarity change is accompanied by a polarity change of the voltage across ohmic resistor RL. This polarity change, which marks the beginning of Tt, is passed on to input T9 of sawtooth generator B through amplifier A. After this polarity change, the amplitude of the sawtooth-shaped voltage rises linearly during the time interval Tt. Thus, the amplitude of the sawtooth-shaped voltage is a measure of Tt-Td and forms the signal S1 which is present at input T6 of amplifier C. Signal S2 is present at input T5 of amplifier C. When the amplitude of signal S1 becomes equal to the amplitude of signal S2, the output TO of amplifier C changes from low to high. As described above, this renders the amplitude of the sawtooth-shaped voltage substantially equal to zero. The amplitude of signal S2 is now higher again than that of signal S1, and the output TO of amplifier C changes from high to low.

Figure 3:
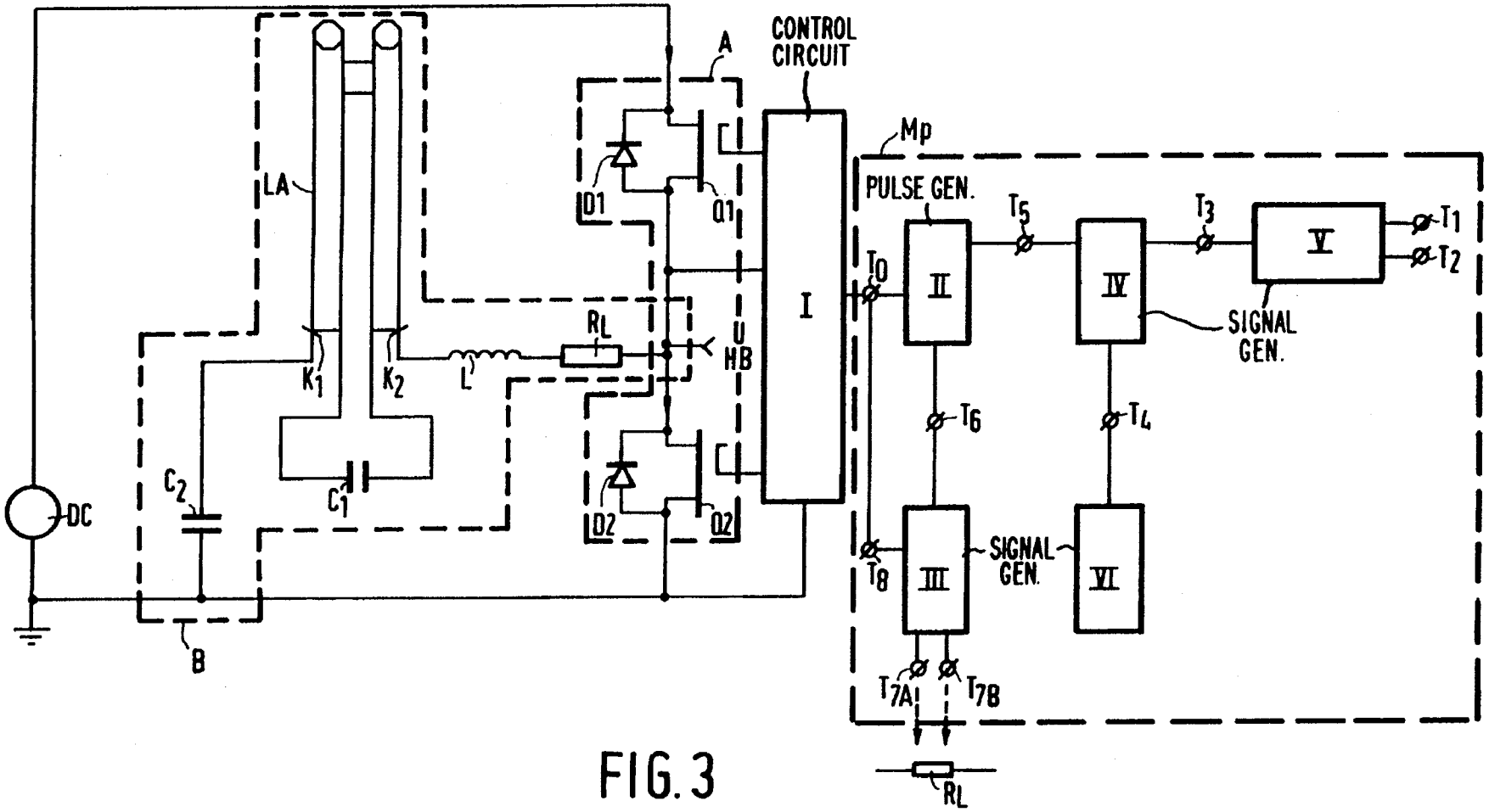
FIG. 3 is a diagram of a further circuit arrangement according to the invention.

FIG. 3 shows a circuit arrangement which differs from the circuit arrangement shown in FIG. 1 only in the construction of the means for generating the signal S2. These means in the circuit arrangement shown in FIG. 3 are formed by circuit portions IV, V and VI. Circuit portion V forms a means for generating a signal P1 which is a measure of the power consumed by the discharge lamp La. Circuit portion VI forms a means for generating a signal P2 which is a measure of a desired value of the power consumed by the discharge lamp La. Circuit portion IV forms the means for generating signal S2, which is a measure of a desired value of Tt-Td, in dependence on signal P1 and signal P2. Input T1 of circuit portion V is so coupled to the discharge lamp La (in a manner not shown) that a signal is present at input T1 during lamp operation which is a measure of the lamp current. Input T2 of circuit portion V is so coupled to the discharge lamp La (in a manner not shown) that a signal is present at input T2 during lamp operation which is a measure of lamp voltage. An output of circuit portion V is connected to an input T3 of circuit portion IV. An output of circuit portion VI is connected to a further input T4 of circuit portion IV. An output of circuit portion IV is connected to input T5 of circuit portion II.

The operation of the circuit arrangement shown in FIG. 3 is as follows. During lamp operation, circuit portion V generates a signal P1 which is a measure of the power consumed by the discharge lamp La. This signal P1 is applied to input T3 of circuit portion IV. Simultaneously, the further input T4 of circuit portion IV receives a signal P2 generated by circuit portion VI which is a measure of a desired value of the power consumed by the discharge lamp La. Using signal P1 and signal P2, circuit portion IV generates a signal S2 which is a measure of a desired value of Tt-Td. The amplitude of signal S2 is such that the power consumed by the discharge lamp is substantially equal to the desired power consumed by the discharge lamp La. It is thus ensured that the power consumed by the discharge lamp La is controlled at a desired value. If the desired value of the power consumed by the discharge lamp La is adjustable, it is possible to adjust the luminous flux of the discharge lamp La over a very wide range as desired. Owing to the unequivocal relation between the parameter Tt-Td and the power consumed by the discharge lamp La, it is possible to have the discharge lamp operate in a stable manner even at a comparatively low desired value of the consumed power. The operation of the further portions of the circuit arrangement shown in FIG. 3 is similar to the operation of corresponding portions of the circuit arrangement shown in FIG. 1.

Figure 4:
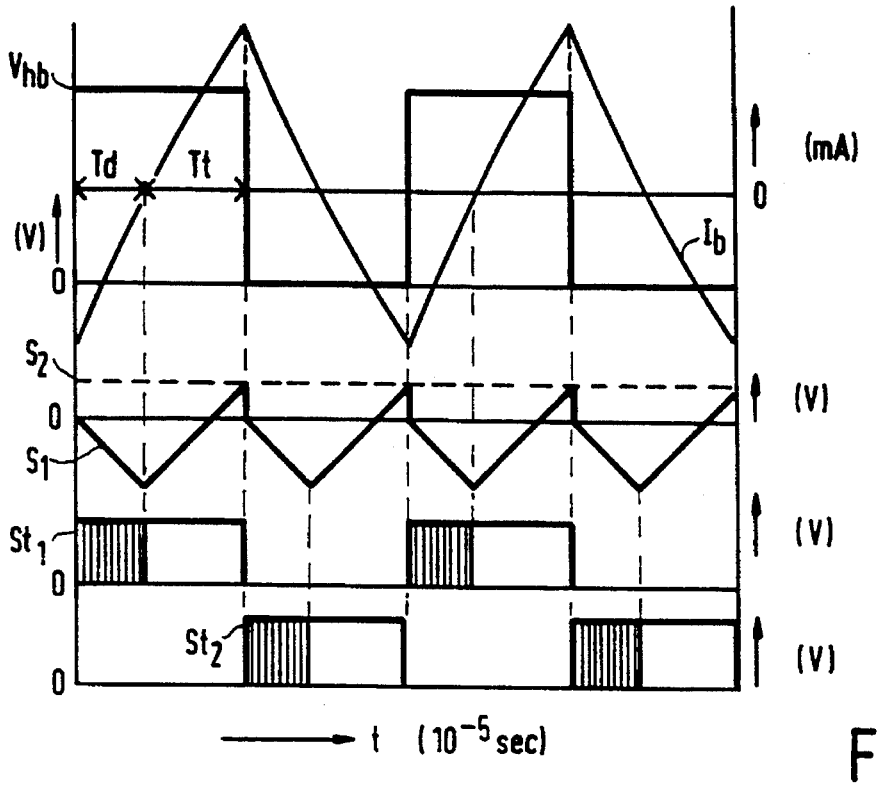
FIG. 4 shows the time-dependent behaviour of currents and voltages present in the circuit arrangement of FIG. 1 during lamp operation.

In FIG. 4, Vhb is the substantially square-wave voltage which is present at the junction point of the two switching elements Q1 and Q2 during lamp operation. Ib is the current which flows in the load branch as a result of this voltage. The time intervals Td and Tt are also shown in the first half cycle of Vhb. Below this, the signal waveforms S1 and S2 are shown against the same time base. The signals St1 and St2 are control signals by which the switching elements Q1 and Q2 are rendered conducting and nonconducting. The relevant switching element is conducting when St1 or St2 is not equal to zero. It is visible that the action of rendering a switching element non-conducting (falling edge of St1 or St2) substantially coincides with the moment signal S1 is equal to signal S2 and with a rising or falling edge of Vhb. Each switching element is made conducting while the diode shunting the switching element is in the conducting state (during Td). This is shown hatched in FIG. 4.

Figure 5:
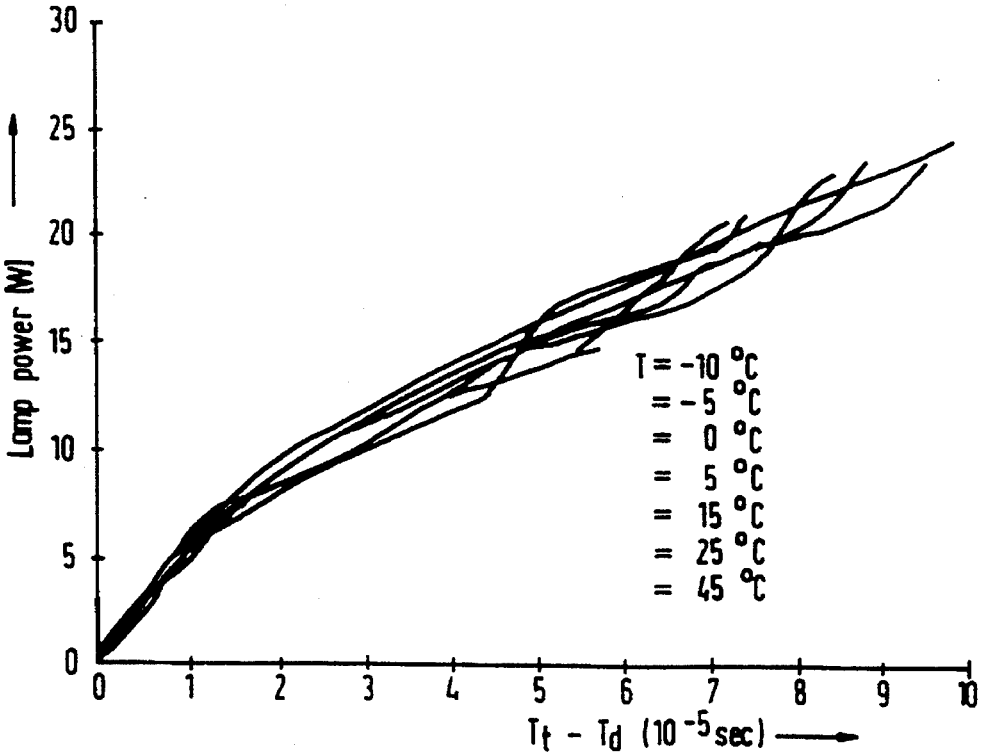
FIG. 5 shows the power consumed by a compact fluorescent lamp as a function of a parameter Tt-Td for a few temperatures. The compact fluorescent lamp was operated on a circuit arrangement as shown in FIG. 1 and the parameter Tt-Td was used for adjusting this power.

FIG. 5 shows the power consumed by a discharge lamp dependent upon the parameter Tt-Td and for a number of ambient temperatures. The discharge lamp is a compact fluorescent lamp of the PL type. It is first of all apparent that there is an unequivocal relation between the parameter Tt-Td and the power consumed by the discharge lamp La, in particular even at low power levels. It is also evident that the ambient temperature has only a slight influence on the relation between the parameter Tt-Td and the consumed power.

We claim:

1. A DC/AC converter circuit arrangement for operating a discharge lamp, comprising:

a branch A having ends for connection to a DC voltage source and comprising a series circuit of two switching elements for generating a periodic voltage by being conducting and non-conducting alternately at a frequency f, each switching element being shunted by a respective diode, a control circuit coupled to control electrodes of the switching elements for rendering the switching elements conducting and non-conducting alternately at the frequency f, a load branch B which shunts one of the switching elements and which comprises inductive means and means for coupling the discharge lamp to the load branch, and means for adjusting the power consumed by the discharge lamp, wherein said adjusting means comprise means for adjusting the value of the time difference Tt-Td, in which Tt is a time interval during which one of the switching elements is conducting during a half cycle of the periodic voltage, and Td is a time interval during which a diode is conducting during the same half cycle of the periodic voltage.

2. A DC/AC converter circuit arrangement as claimed in claim 1, wherein the time difference adjusting means comprise:

means for generating a signal S1 which is a measure of the time difference Tt-Td, means for generating a signal S2 which is a measure of a desired value of the time difference Tt-Td, and means for rendering the signal S1 substantially equal to the signal S2.

3. A DC/AC converter circuit arrangement as claimed in claim 2, wherein the means for generating the signal S2 comprises:

means for generating a signal P1 which is a measure of the power consumed by the discharge lamp, and means for generating a signal P2 which is a measure of a desired value of the power consumed by the discharge lamp.

4. Apparatus for operating an electric discharge lamp comprising:

a pair of input terminals for connection to a source of supply voltage, a first branch circuit including first and second controlled semiconductor switching devices connected in series circuit to said pair of input terminals, first and second diodes connected in shunt with said first and second semiconductor switching devices, respectively, a load branch circuit coupled in shunt with one of said first and second semiconductor switching devices and comprising an inductor and means for coupling the load branch circuit to a discharge lamp, a control circuit coupled to control electrodes of the first and second semiconductor switching devices to drive the semiconductor switching devices alternately into conduction and non-conduction at a periodic frequency f thereby to generate a periodic voltage for the load branch circuit, and means coupled to the control circuit for adjusting the power consumed by a discharge lamp when the lamp is coupled to the load branch circuit, wherein said power adjusting means comprise means for deriving a control signal determined by the value of a time difference Tt-Td, wherein Tt is a time interval during which one of the switching devices conducts during a half cycle of the periodic voltage, and Td is a time interval during which a diode conducts during the same half cycle of the periodic voltage.

5. The lamp operating apparatus as claimed in claim 4 wherein said time difference control signal deriving means comprise;

first means for generating a first signal determined by the actual time difference Tt-Td, second means for generating a second signal determined by a desired value of the time difference Tt-Td, and means responsive to said first and second signals for making the first signal substantially equal to the second signal.

6. The lamp operating apparatus as claimed in claim 5 wherein the second generating means comprise;

third means for generating a third signal determined by the power consumed by a connected discharge lamp, fourth means for generating a fourth signal determined by the desired power to be consumed by a connected discharge lamp, and means responsive to said third and fourth signals for deriving said second signal.

7. The lamp operating apparatus as claimed in claim 5 wherein said second generating means comprise an adjustable resistive voltage divider connected across said pair of input terminals.

8. The lamp operating apparatus as claimed in claim 4 wherein the inductance of said inductor in the load branch circuit is chosen such that the load branch circuit exhibits an overall inductive impedance at the periodic frequency f.

9. The lamp operating apparatus as claimed in claim 4 wherein said time difference control signal deriving means comprise;

first means for generating a first signal determined by the actual time difference Tt-Td, said first generating means including means responsive to lamp current and lamp voltage of a connected discharge lamp for deriving at its output an actual power control signal, and a sawtooth generator having a first input coupled to said output of the actual power control signal deriving means, a second input, and an output at which said first signal is produced, second means for generating a second signal determined by a desired value of the time difference Tt-Td, and means responsive to said first and second signals for deriving at its output said control signal, said output being coupled to said control circuit and to said second input of the sawtooth generator.

10. The lamp operating apparatus as claimed in claim 4 wherein said time difference control signal deriving means comprise;

first means for generating a first signal determined by the actual time difference Tt-Td, and second means for generating a second signal indicative of a desired value of the time difference Tt-Td and which comprises;

means for generating a signal indicative of the power consumed by a connected discharge lamp, means for generating a further signal indicative of a desired value of the power consumed by a connected discharge lamp, means for combining said signal and said further signal to derive said second signal, and means responsive to said first and second signals to derive said control signal which in turn controls the control circuit.

11. The lamp operating apparatus as claimed in claim 4 wherein said source of supply voltage is a DC voltage, wherein said time difference control signal deriving means comprise;

first means for generating a first signal determined by the actual time difference Tt-Td, second means for generating a second DC signal determined by a desired value of the time difference Tt-Td, and said first generating means comprise, a sawtooth generator having a first input which receives a signal determined by the actual power consumed by a connected discharge lamp, an output coupled to a first input of a comparator having a second input that receives said second DC signal and an output at which said time difference control signal is produced, and means coupling said output to the control circuit and to a second input of the sawtooth generator.

12. The lamp operating apparatus as claimed in claim 4 wherein the control circuit maintains the periodic frequency f constant but adjusts the conduction time intervals Td and Tt in response to adjustment of a desired value of power to be consumed by a connected discharge lamp.

13. Apparatus for operating an electric discharge lamp comprising:

a pair of input terminals for connection to a source of supply voltage, a load circuit for coupling to an electric discharge lamp and which is coupled to one input terminal, first and second controlled semiconductor switching devices connected to said pair of input terminals and to said load circuit so as to control current flow in the load circuit, first and second diodes connected in shunt with said first and second semiconductor switching devices, respectively, a control circuit coupled to control electrodes of the first and second semiconductor switching devices to drive the semiconductor switching devices alternately into conduction and non-conduction at a periodic frequency f thereby to generate a periodic voltage for the load circuit, and means coupled to a control input of the control circuit for supplying it with a control signal for adjusting the power consumed by a discharge lamp when the lamp is coupled to the load circuit, wherein said power adjusting means derives said control signal as a function of the relative conduction times of a controlled semiconductor switching device and a diode, said power adjusting means including means for adjusting the value of a time difference parameter Tt-Td, wherein Tt is a time interval during which one of the switching devices conducts during a half cycle of the periodic voltage, and Td is a time interval during which a diode conducts during the same half cycle of the periodic voltage.

* * * * *